United States Patent [19]

Martz

[11] 4,102,248

[45] Jul. 25, 1978

[54] PROTECTIVE SYSTEM FOR PNEUMATICALLY OPERATED DEVICES

[75] Inventor: Lyle F. Martz, Penn Hills, Pa.

[73] Assignee: Westinghouse Electric Corp., Pittsburgh, Pa.

[21] Appl. No.: 665,134

[22] Filed: Mar. 8, 1976

[51] Int. Cl.[2] ..... F15B 15/26

[52] U.S. Cl. ..... 91/42; 91/43; 91/44; 91/361

[58] Field of Search ..... 91/41, 42, 44, 45, 43, 91/361

[56] References Cited

U.S. PATENT DOCUMENTS

| | | | |
|---|---|---|---|
| 2,331,108 | 10/1943 | De Ganahl | 91/41 |
| 2,984,984 | 5/1961 | Dickey | 122/448 S |
| 3,028,844 | 4/1962 | Durham | 122/479 A |
| 3,361,034 | 1/1968 | Rothrock | 91/42 |
| 3,633,603 | 1/1972 | Furlong | 91/44 |
| 3,641,877 | 2/1972 | Hebert | 91/44 |
| 3,654,833 | 4/1972 | Griffiths | 91/41 |
| 3,779,135 | 12/1973 | Sugimura | 91/45 |
| 3,895,779 | 7/1975 | Cassez | 91/44 |

*Primary Examiner*—Martin P. Schwadron
*Assistant Examiner*—Abraham Hershkovitz
*Attorney, Agent, or Firm*—J. J. Wood

[57] ABSTRACT

This disclosure relates to a system for protecting pneumatic cylinders and diaphragm valves against failure of both electrical and pneumatic supplies. In the event of a failure of the air supply, the loss of air pressure is detected and all drives are locked in position. The position pneumatic feedback signal from the pneumatic cylinder diaphragm valve is then connected directly to a pneumatic memory. Thus when the air supply recovers, the pneumatic memory will be equal to the instantaneous position of the pneumatic cylinder or diaphragm valve.

In the event of an electrical failure, a solenoid valve interrupts the flow of the pneumatic signal from an electropneumatic transducer to the pneumatic memory, so that the air cylinder or valve is directly connected to the pneumatic memory. By selectively energizing a pair of solenoid valves connected to the memory, the operator using an emergency d.c. source can then slue the memory up or down as required for control purposes until the restoration of the electrical supply.

1 Claim, 1 Drawing Figure

PROTECTIVE SYSTEM FOR PNEUMATICALLY OPERATED DEVICES

BACKGROUND OF THE INVENTION

1. Field of the Invention

This invention relates to a system for the protection of pneumatic cylinders and diaphragm valves against failure of either the electrical supply or the pneumatic supply or both.

2. Description of the Prior Art

A perennial problem in the pneumatic arts is how to protect against the sudden loss of the air supply, and also electrical failure which could be catastrophic particularly in boiler operation. It is axiomatic that almost any engineering problem can be solved if one is willing to bear the expense. The present invention makes use of known components which are combined into a novel system to inexpensively solve the problems associated with pneumatic and electrical failures.

SUMMARY OF THE INVENTION

The invention relates in part to a protective system for immobilizing a pneumatically operated device in the event of loss of air supply. Means sense the air supply by providing a signal P which is a function of the magnitude of the pressure of said air supply. Means for braking the pneumatically operated device include an air chamber, the braking action being inhibited when the air chamber is under pressure. First and second pneumatically operated relays, each having an operating chamber, are arranged with the operating chamber of said first relay being connected with the sensing means to receive the signal P which keeps said first relay normally closed. The first pneumatic relay is connected to the air chamber and to the operating chamber of said second relay, the second relay being normally open and connected to said air chamber through a needle valve and to said air supply. When the air supply fails, the signal P goes to zero causing the first relay to open and port to the atmosphere, exhausting the air chamber and the operating chamber of said second relay which thereby closes thus actuating the brake means and disconnecting the air supply.

A solenoid valve is connected between an electropneumatic transducer signal means and a pneumatic memory. A third pneumatic relay normally closed and having an operating chamber connected to said signal P is connected in the position feedback path from the air cylinder or diaphragm valve to the pneumatic memory. In the event of electrical failure, the solenoid valve closes, isolating the pneumatic memory from the electropneumatic transducer, and the third pneumatic relay opens connecting the pneumatic feedback path directly to the memory. Additional means operating from an emergency d.c. power supply can be used to pneumatically increase or decrease the magnitude of the pneumatic memory.

DESCRIPTION OF A PREFERRED EMBODIMENT

Figure 1:
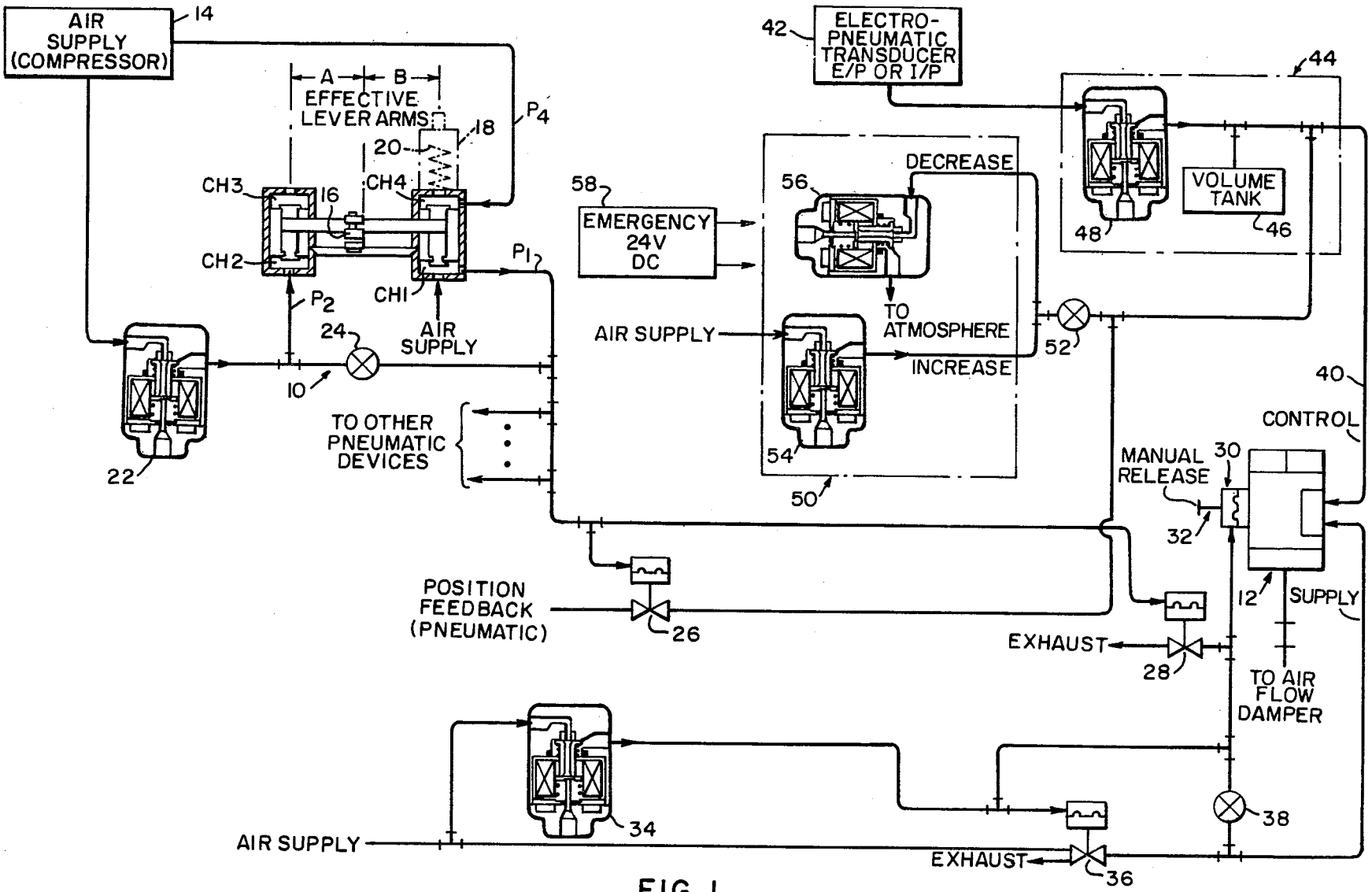
FIG. 1 is a schematic diagram depicting the electropneumatic protective system for air cylinders and diaphragm valves in accordance with the invention.

Referring now to FIG. 1 there is shown the electric and pneumatic failure protective system for devices such as pneumatic cylinders and diaphragm valves.

A pressure switch indicated generally at 10 provides a pressure $P_1$ which is sent by pipe or tubing to supply fluid (air) power to various devices. In the illustrative embodiment of FIG. 1, the pneumatic device to be protected is a pneumatic cylinder or positioner indicated generally at 12 which may for example be used to control the air flow damper on a boiler.

A compressor indicated symbolically at 14 provides air pressure to the pressure switch 10 which delivers the pressure $P_1$. Any pneumatic or electrical pressure switch may be used to provide the signal $P_1$. In the embodiment here illustrated, the switch 10 is a Hagan Ratio Totalizer manufactured by Westinghouse Electric Corp. Briefly this switch is a pneumatically operated force-balance device designed to receive as many as three spring forces and three pneumatic input signals, and convert them into a single pneumatic output signal. In this utilization there are four chambers Ch1, Ch2, Ch3, and Ch4. The fulcrum 16 is adjustable to change the effective length of the lever arms A and B. The chamber Ch4 is fitted with a spring barrel 18 for receiving a spring indicated symbolically in phantom at 20. The air supply 14 is applied to chamber Ch2 through solenoid valve 22, and to chamber Ch1 directly. A needle valve 24 connects the output $P_1$ to chamber Ch2.

The switch 10 adds three forces: the spring tension, the air supply pressure and the feedback signal $P_1$. When A is greater than B and $P_4$ exceeds the tension in spring 20, $P_1$ is raised from zero to equal the air supply pressure. The ratio A/B determines the differential gap adjustment or change in $P_4$ which will return $P_1$ to zero.

The pressure $P_1$ is supplied to pneumatic relays 26 and 28. The relay 28 is connected to the diaphragm chamber 30 of a mechanical brake identified generally at 32. The air supply is connected to diaphragm chamber 30 through solenoid valve 34 and pneumatic relay 36. A needle valve 38 is connected in series with the air supply, the pneumatic relay 36, and with the diaphragm chamber 30. The positioner 12 receives a pneumatic control signal via pipe or tubing 40. The pneumatic control signal is received from an electropneumatic transducer 42 and may be either voltage to pneumatic E/P or current to pneumatic I/P. The pneumatic control signal may be applied directly to the positioner 12 or a pneumatic memory indicated generally at 44 may be inserted in the conduit 40 between the electropneumatic transducer 42 and the positioner 12.

The pneumatic memory 44 includes a volume tank 46 connected from the transducer 42 through a solenoid valve 48. In a further refinement the volume tank 46 and the conduit 40 are connected to an M/A (Manual-automatic) station, indicated generally at 50, through a needle valve 52. The M/A station conveniently mounted on a console comprises two solenoid operated valves 54 and 56. The valve 54 is connected to the air supply while the valve 56 vents to the atmosphere.

OPERATION

The fail safe system afforded by the invention is designed to protect against both pneumatic as well as electrical failure.

The pneumatic relays are operated by means of a spring coupled to a diaphragm which is connected to and subjected to air pressure. The valves physically have three ports so that two may be selected with the unused one covered by a plug to provide a valve which is either open or closed under air pressure. The relay may be operated as a three way valve to accomplish two functions: through flow and exhaust; in the embodiment here illustrated the valve 36 is so connected so that when it is subjected to air pressure the diaphragm compresses the spring and the ports are open supplying air to positioner 12. Conversely when air is removed from the diaphragm of relay 36, the air from positioner 12 is exhausted to atmosphere. Valves 26 and 28 are connected so that when air pressure is on the diaphragm the ports are closed.

The mechanical brake 32 operates in a similar manner. When air is supplied to the diaphragm chamber 30 the brake is held disengaged. When the air pressure is exhausted to atmosphere, the diaphragm is physically displaced and the brake is engaged holding the positioner 12 in position. In normal operation relays 26 and 28 are closed, relay 36 is open, and solenoid valves 48 are open. Assume now that the air supply has failed either totally or for some reason it has been reduced below acceptable levels. It is the function of the pressure switch 10 to detect such a change in pressure. Suppose for example below 50 psi is unacceptable. If then the supply $P_4$ falls below 50 psi, $P_1$ will go to zero. When this happens relays 26 and 28 will open. When relay 26 opens, the position feedback is connected directly to the pneumatic memory 44. Thus when the air supply recovers, the volume tank memory 46 will be equal to the position of the air cylinder or diaphragm valve. The opening of relay 28 exhausts the air in the chamber 30 and the mechanical brake 32 is engaged holding the positioner 12 in whatever displacement it had achieved prior to pneumatic failure. The opening of relay 28 also exhausts the air pressure in the diaphragm of relay 36 and it closes exhausting the air supply to the positioner 12.

When the air supply is restored, the operator by means of a push button temporarily energizes the solenoid valve 22 to restore the control signal $P_1$. P2 is then maintained by needle valve 24 from $P_1$ until $P_4$ again decreases below acceptable pressure. With the air pressure restored the pressure $P_1$ closes relays 26 and 28. The operator by means of a pushbutton temporarily energizes the solenoid valve 34, air is restored to relay 36 and it opens. The air supply then goes through relay 36 and through the needle valve 38 to the brake chamber 30 and to the diaphragm chamber of relay 36.

In the event of an electrical failure, the solenoid valve 48 closes. The volume tank 46 holds the pressure which is applied by conduit 40 to the positioner 12. The air cylinder will then follow the memory irrespective of the output of the transducer 42. The operator by means of the emergency 24 v.d.c. supply can energize the solenoid valve 54 to supply more pressure to the memory 44 through needle valve 52, or solenoid valve 56 can be energized to exhaust air from memory unit 44 to the atmosphere through needle valve 52. The operator can thus operate the positioner 12 during this emergency state. When electrical supply is restored the solenoid valve 48 is again energized and it opens, again connecting transducer 42 to the memory 44.

What is claimed is:

1. A protective system for immobilizing a pneumatically operated device in the event of loss of air supply comprising:

means for sensing the air supply providing a signal P which is a function of the magnitude of pressure of said air supply;

means for braking said pneumatically operated device, having an air chamber said braking means being inactivated by the presence of air pressure;

a needle valve;

first and second pneumatically operated relays, each having an operating chamber, the operating chamber of said first relay being connected to said sensing means to receive said signal P which keeps said first relay normally closed, said first relay being connected to said air chamber and to the operating chamber of said second relay said second relay being normally open and connected to said air chamber through said needle valve, and to said air supply, whereby when the air supply fails said signal P goes to zero causing said first relay to open to atmosphere exhausting said air chamber in the operating chamber of said second relay which thereby closes thus actuating the brake means and disconnecting the air supply;

an electropneumatic transducer means for sending a pneumatic control signal;

a solenoid valve connected in series with said electropneumatic transducer means;

a pneumatic memory means interposed between said solenoid valve and said pneumatically operated device for maintaining an air pressure which is a function of the displacement of said pneumatically operated device; and a third pneumatic relay having an operating chamber connected to said signal P having ports which are normally closed, said third pneumatic relay connecting a pneumatic feedback signal from said pneumatically operated device to said pneumatic memory means whereby when said signal P goes to zero, said ports open and the pneumatic feedback signal is connected directly to said pneumatic memory.

* * * * *